US006825407B1

(12) United States Patent
Curren

(10) Patent No.: US 6,825,407 B1
(45) Date of Patent: Nov. 30, 2004

(54) VIBRATORY PERCUSSION INSTRUMENT

(76) Inventor: Michael T. Curren, 7432 Berkshire Downs Dr., Raleigh, NC (US) 27616

( * ) Notice: Subject to any disclaimer, the term of this patent is extended or adjusted under 35 U.S.C. 154(b) by 174 days.

(21) Appl. No.: 10/372,532

(22) Filed: Feb. 21, 2003

Related U.S. Application Data

(60) Provisional application No. 60/358,296, filed on Feb. 21, 2002.

(51) Int. Cl.[7] ..... G10D 13/08
(52) U.S. Cl. ..... 84/402; 84/403
(58) Field of Search ..... 84/402, 403, 404, 84/406, 410

(56) References Cited

U.S. PATENT DOCUMENTS 3,859,886 A * 1/1975 Brisco, Sr. ..... 84/402
3,893,363 A * 7/1975 Cohen ..... 84/402

* cited by examiner

*Primary Examiner*—Kimberly Lockett
(74) *Attorney, Agent, or Firm*—Mills Law Firm PLLC

(57) ABSTRACT

A vibratory percussive instrument having an elongated curvilinear yoke connected at a center section to an instrument stand and an impact pad at the end of an arm for striking with a percussive instrument and a pin type resonator at the end of a lower arm for producing a prolonged resonance upon impacting the pad.

7 Claims, 2 Drawing Sheets

VIBRATORY PERCUSSION INSTRUMENT

RELATED APPLICATION

This application claims the benefit under 35 USC 121 of U.S. Provisional Patent Application No. 60/358,296 filed on Feb. 21, 2002 in the name of Michael T. Curren and entitled "Vibrator Percussion Device".

FIELD OF THE INVENTION

The present invention relates generally to a music enhancing devices and, in particular, to a percussion device having an induced vibratory resonance.

BACKGROUND OF THE INVENTION

Various percussion devices have been proposed for creating music enhancing effects when struck manually or with a percussive instrument. Oftentimes, the devices are mounted as part of a drum set or clamped on an independent stand. Examples are a cowbell directly mounted on a drum as disclosed in U.S. Pat. No. 5,684,258 to Liao; a free standing cowbell as disclosed in U.S. Pat. No. 5,986,195 to DeArmas; a corrugated resonator clamped to a drum as disclosed in U.S. Pat. No. 5,986,195; and the drum mounted cymbal as disclosed in U.S. Pat. No. 2,971,738 to Way.

One particular percussion resonating device, known as a "Vibra-Slap" from Latin Percussion, Inc. and disclosed in U.S. Pat. No. 3,459,572 to Cohen, couples a hand held instrument having a ball on a lower arm that is struck on the bottom with the hand and induces a vibration response in a resonator cavity mounted on an upper arm that contains a plurality of loosely supported pins. The resonating effect simulates a periodic rattling effect associated with a jawbone commonly used with Latin American music. In addition to requiring both hands of the instrumentalist for operation, the resonation is quickly damped, lasting only about two to three seconds or less.

BRIEF SUMMARY OF THE INVENTION

The present invention provides a jawbone-type percussion instrument having an extended and rich response. The instrument comprises a support bar having a pair of extending arms integral with a center section that is clamped on an accessory mount. A jawbone resonator is fixed on the outer end of the lower arm, as opposed to the conventional upper arm, and a circular strike pad is fixed on the outer end of the upper arm. The center section is resiliently coupled with the accessory mount at an elastomeric sleeve. The pad and the resonator have substantially equal weights and cantilevered lengths. When the impact is struck with a percussive instrument such as a drumstick, long lasting vibration energy is transferred without dampening at the clamp to the resonator, effecting an extended resonating period. The effects are further enhanced by the strike pad, which comprises a low durometer impact surface laminated to a rigid disk and mutes the stick impact and provides natural rebound. Additionally, rather than occupying both hands of the instrumentalist, the momentary impact allows other percussive effects to be undertaken by the percussionist during the resonance period.

Accordingly, it is an object of the invention to provide a resonating percussive instrument having an extended resonating period.

Another object is to provide a resonating percussive instrument that may be independently mounted and played with one hand using conventional percussive devices such as drumsticks.

A further object is to provide an improved jawbone type resonating instrument that is resiliently mounted to reduce resonance dampening and prolong the desired acoustical effect.

DESCRIPTION OF THE DRAWINGS

The above and other features of the invention will become apparent upon reading the following written description taken in conjunction with the accompanying drawings in which.

DETAILED DESCRIPTION OF THE PREFERRED EMBODIMENTS

Figure 1:
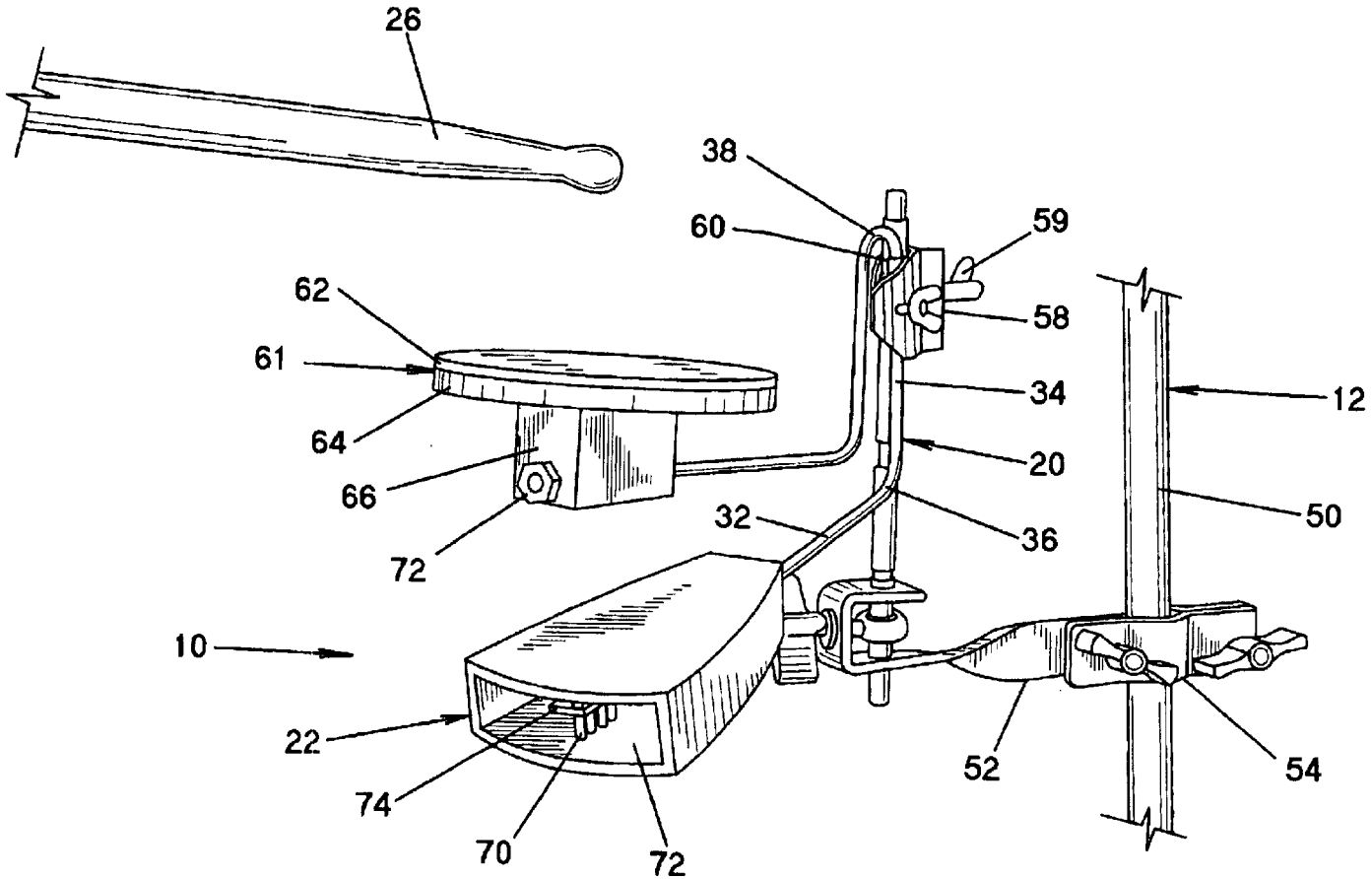
FIG. 1 is a perspective view of a vibratory percussive instrument according to a preferred embodiment mounted on an accessory stand and played using a drum stick.
Figure 2:
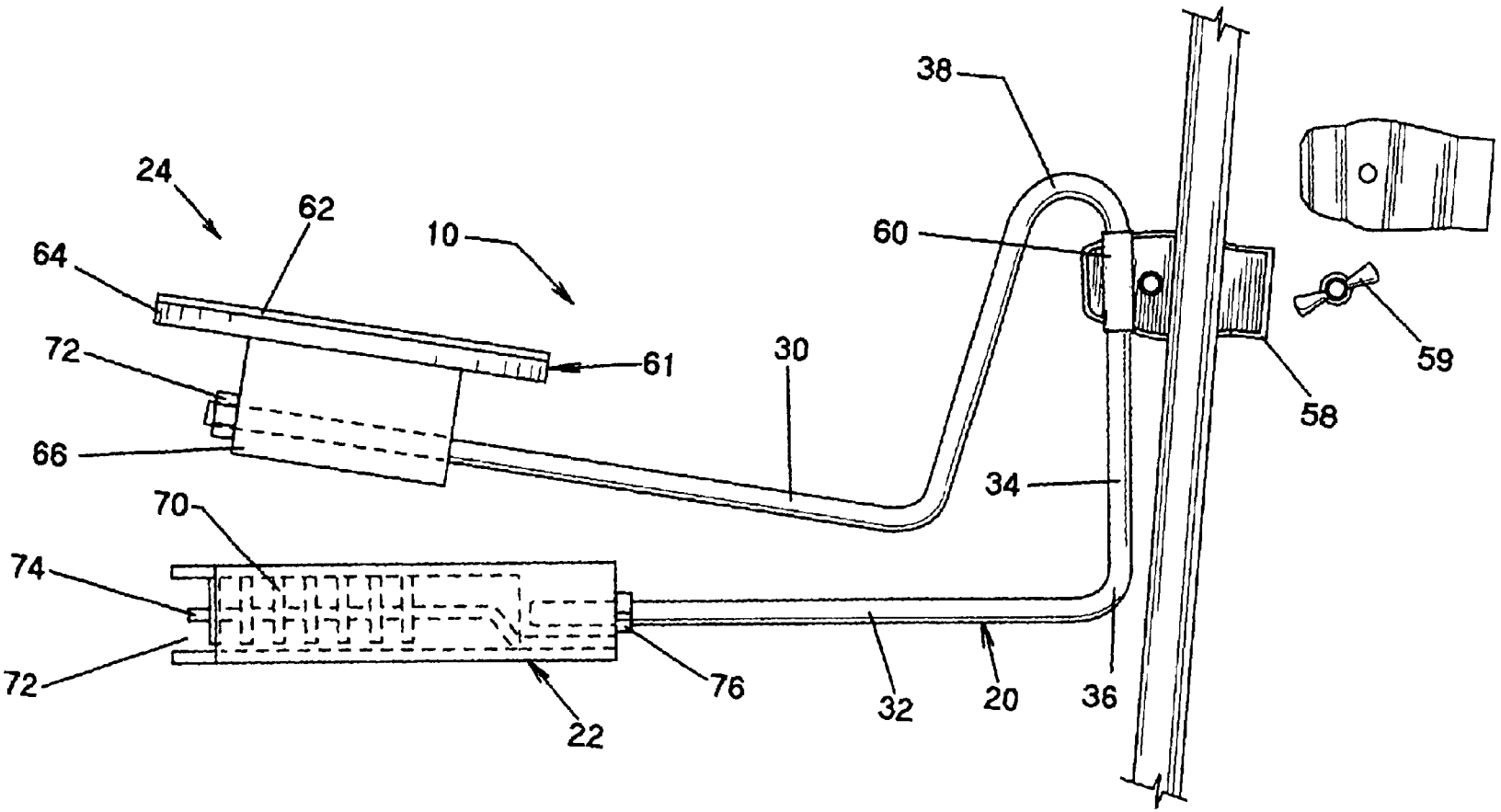
FIG. 2 is a side elevational view of the vibratory percussive instrument of FIG. 1 with the mounting clamp partially disassembled to illustrate the resilient mounting of the yoke.

Referring to the drawings for the purpose of illustrating the preferred embodiment and not for limiting same, FIGS. 1 and 2, show a vibratory percussion instrument 10 mounted on an instrument accessory stand 12, which may typically be integrated with or accompany a drum set or other instrumental station.

The device 10 includes an elongated cylindrical metal support bar or yoke 20 carrying at distal ends a lower resonator 22 and an upper impact pad 24 that is struck on a top surface with a drum stick 28 for inducing vibration to the resonator and producing an extended jawbone type vibration. The yoke 20 includes a projecting horizontal upper arm 30 and a projecting horizontal lower arm 32 interconnected by a vertical center arm 34. The lower arm 32 is generally straight and connected to the center arm 34 at a generally right angle bend 36. The upper arm 30 lies in a common plane with the other arms and is generally L-shaped and connected to the center section at an inverted U-shaped top loop 38. The upper arm 30 diverges slightly upwardly and outwardly at an inclination of about 10°. The upper arm 30 includes an outer threaded end, and the lower arm 32 also includes a threaded outer end section for facilitating assembly and adjustment of the components. The yoke 20 is formed of cylindrical bar stock and may be plated, painted or otherwise surface finished as desired.

An adjustable clamp assembly 52 adjustably mounts the instrument 10 at a vertical support bar 50 of the stand 12. The clamp assembly 52 includes a split clamp 54 attached at one end to the support bar 50 and carrying at the other end a vertical post 56. A split clamp 58 adjusted by wing fasteners 59 provides variable vertical and circumferential coupling of the center arm of the yoke 20 to the post 56. As shown in FIG. 2, an elastomeric compliant spacer or sleeve 61 surrounds and elastically supports the center arm to reduce dampening of induced vibration and effect a prolonged vibratory response when the pad is impacted by the drum stick. It will be appreciated that many commercially available stands and accessories are available to the instrumentalist and could alternatively be used for mounting of the instrument 10.

The strike pad 24 is carried at the outer end of the upper arm 30. The resonator 22 is carried at the outer end of the lower arm 32. This inversion of the resonator 22 has been found to further increase the resonance period.

The stick pad assembly 24 comprises a two-piece disk 61 having an upper plate 62 that is adhered to a circular support plate 64. The support plate 64 is connected at a lower surface to a rectangular mounting block 66. The mounting block 66 includes a longitudinal hole 68 for receiving the threaded end of the upper arm 30. An inner nut 70 is threaded on the inner end of the threaded section and engages the inner end surface of the mounting block 66. An outer nut 72 is threaded on the outer end of the threaded section and engages the outer end surface of the mounting block 66. The nuts 70 and 72 are reversely tightened to clamp the mounting block 66 on the upper arm 24. Alternatively a compressive fit of the outer end into a corresponding hole in the block could be used.

The impact plate 62 is formed of a low durometer elastic material, such a rubber. The elasticity of the plate 62 has been found to mute the stick impact and provide a desired rebound of the drumstick. The support plate 64 is preferably formed on a nonflexible material, such as plastic, wood or metal. For enhancing resonance, the mounting block 44 is formed of wood or like material. It has been found that the resilient impact surface rigidly coupled to the yoke 20 with the rigid block and support plate also contributes to an extended resonance period.

The resonator 22 may be a commercial available design, such as disclosed in the aforementioned patent to Cohen, and comprises a plurality of loosely supported pins 70 carried on the upper and lower surfaces in an outwardly flared center cavity 72 of a resonator body 74. The pins 70 are separated by a center tongue 74 having an offset end attached to the rear wall of the resonator body 74. Upon induced vibration occasioned by impact by the drumstick, the pins coact with the upper and lower walls of the resonator body and the tongue to provide an acoustic effect of a type well known in the art. The threaded end of the lower arm 32 is received in a threaded bore on the base wall of the resonator 22 and locked in place by nut 76.

To obtain an extended resonance period upon striking the pad disk, it is important to have the weights of the pad 30 and resonator 32 and the horizontal lengths of the upper and lower arms substantially equal. The resonance is further enhanced by the resilient support at the sleeve 60 and clam 58, inasmuch as the present invention has determined that a rigid connection attenuates and shortens the desired induced vibration. The resonance effect may be further influenced by varying the attachment location on the vertical center arm 34 of the yoke 34.

With the foregoing component, an instrumentalist hitting the strike pad 24 with a drumstick 26 will provide an elongated enhanced rattling effect at the resonator. In extended testing it has been determined that a resonance period about double conventional devices is achieved with light to medium drumstick impact. The resonator may be varied with respect to its longitudinal axis to produce varied effects.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed:

1. A percussion apparatus, comprising: an accessory support having an attachment post; a percussive instrument having an elongated metallic bar having a vertical center section and an upper arm and a lower arm projecting outwardly from respective ends thereof, a pin-type resonator device connected at an outer end of the lower arm, a circular impact device having a resilient upper portion and a rigid lower portion connected at an outer end of said upper aim; elastomeric spacer means on said center section of said bar; and clamp means for engaging said spacer means for attaching said bar to said attachment post wherein the weights of said resonator device and said impacts device and the lengths of said upper arm and said lower arm are substantially the same whereby striking the impact device with a drumstick induces a prolonged resonation in said resonator device.

2. A vibratory percussion device for mounting on an instrument stand, comprising: an elongated metallic yoke having a center section resiliently coupled to the instrument stand and upper and lower arm sections connected with the center section and projecting outwardly therefrom, said upper arm section and said lower arm section having substantially equal lengths; a circular impact disk connected to an outer end of said upper arm section; and a resonator cavity device connected to an outer end of said lower arm section, said resonator inducing a prolonged resonation in said resonator cavity device when the impact disk is struck with a percussive instrument.

3. The vibratory percussion device as recited in claim 2 wherein said upper arm section and said lower arm section have substantially equal length.

4. The vibratory percussion device as recited in claim 3 wherein the upper surface of said impact device is resilient.

5. The vibratory percussion device as recited in claim 4 wherein said upper surface is a low durometer rubber.

6. The vibratory percussion device as recited in claim 5 including clamping means for attaching said yoke to said instrument stand.

7. The vibratory percussion device as recited in claim 6 including compliant spacer means interposed between said clamping means and said yoke.

* * * * *